US005830058A

United States Patent [19]

Røsjø

[11] Patent Number: 5,830,058

[45] Date of Patent: Nov. 3, 1998

[54] ARRANGEMENT RELATING TO A VENTILATION INSTALLATION MOUNTED TO A CEILING

[75] Inventor: Kjell Røsjø, Fjellhamar, Norway

[73] Assignee: AET Arbeidsmiljø og Energiteknikk A/S, Strømmen, Norway

[21] Appl. No.: 663,217

[22] PCT Filed: Dec. 6, 1994

[86] PCT No.: PCT/NO94/00196

§ 371 Date: Aug. 21, 1996

§ 102(e) Date: Aug. 21, 1996

[87] PCT Pub. No.: WO95/16168

PCT Pub. Date: Jun. 15, 1995

[30] Foreign Application Priority Data

Dec. 6, 1993 [NO] Norway ..... 934439

[51] Int. Cl.[6] ..... F24F 9/00

[52] U.S. Cl. ..... 454/187; 454/192

[58] Field of Search ..... 454/187, 188, 454/189, 190, 192, 906

[56] References Cited

U.S. PATENT DOCUMENTS

| | | | |
|---|---|---|---|
| 3,023,688 | 3/1962 | Kramer, Jr. | 454/190 |
| 3,068,775 | 12/1962 | Zehnder | 454/192 |
| 4,094,232 | 6/1978 | Howorth | 454/190 X |
| 4,137,831 | 2/1979 | Howorth | 454/187 |
| 4,856,419 | 8/1989 | Imai | 454/189 X |

FOREIGN PATENT DOCUMENTS

| | | | |
|---|---|---|---|
| 62-266341 | 11/1987 | Japan | 454/189 |
| 2-161241 | 6/1990 | Japan | 454/188 |
| 3-211336 | 9/1991 | Japan | 454/188 |
| 1530885 | 12/1989 | U.S.S.R. | 454/188 |

*Primary Examiner*—Harold Joyce
*Attorney, Agent, or Firm*—Browdy and Neimark

[57] ABSTRACT

A ceiling-mounted ventilation system assembly, where ventilation air from the ventilation system is directed down towards a working area, and where air is supplied to the ventilation system from indoor air (RL) and/or from external ventilation equipment (SL). The ventilation system is divided into at least two sections (1, 2, 3, 4) each with separate air, where at least one of the sections (1, 2) is designed and positioned so that the airflow therefrom will essentially strike a work table (78) in the working area, while the other section or sections (3, 4) are designed and positioned in such a way that the airflow therefrom will strike areas outside the work table, and where the sections are each independently equipped with devices (5, 6, 7, 8, 57, 58, 59) to control the air volume passing through the section, heat exchanger (29, 30, 31, 32, 33, 34, 35, 81, 82) for controlling the temperature of the air issuing from the section, and filters for ensuring a specify purity of the air which is emitted.

9 Claims, 5 Drawing Sheets

ARRANGEMENT RELATING TO A VENTILATION INSTALLATION MOUNTED TO A CEILING

BACKGROUND OF THE INVENTION

1. Field of the Invention

The present invention relates to a ceiling-mounted ventilation system assembly, where ventilation air from the ventilation system is directed down towards a working area, and where the ventilation system is supplied with air from the indoor air and/or from external ventilation equipment, where the ventilation system is divided into at least two mutually separate air sections, where at least one of the sections is designed and positioned such that airflow therefrom will primarily strike a zone of activity in a working area, whilst the other section or sections are designed and positioned such that the airflow therefrom will strike areas outside the zone of activity, and where each of the said sections is equipped with means to control the volume of air passing through the section, means for controlling the temperature issuing from the section, and means for ensuring a determined purity of the air that is emitted.

The invention may be used in particular in connection with operating theatres in hospitals, although it is not necessarily limited to this application.

2. Prior Art

The purpose of ventilation in an operating theatre is to limit the risk of surgical incisions formed in the patient undergoing an operation being exposed to airborne impurities from unsterile sources. Air ventilation is also essential for the removal of any anaesthesia gases which may permeate the air in the operating theatre.

Compared with conventional turbulent ventilation, vertical, essentially parallel flowing, preferably one-way, downwardly directed airflow and with a more outwardly directed airflow in large parts of the marginal areas can to a considerable extent reduce the number of infections. The advantages of an air exchange system for the whole operating theatre have proven to be particularly favourable. With airflow of this kind, the entire air mass will circulate in one direction and displace the existing air in the operation area. The first essential step for such laminar airflow takes place when incoming air is expelled straight down through microfilters above the operating table. This airflow prevents air masses from becoming mixed in the working area and the air is changed several hundred times per hour in the actual operating zone and somewhat fewer times in the remaining area of the operating theatre.

Furthermore, it is usual that a portion of the total air, e.g., 20% is filtered out of the room and is replaced by fresh air, whilst about 80% of the air in the room circulates, is filtered with replacement air and expelled back into the room. In this way, increased quantities of fresh air will not be needed, which is energy-saving in comparison with the conventional systems.

Ventilation systems of the aforementioned type are supplied by the Finnish company Kojair, among others.

A second known system is supplied by the British company Ollerton Laboratories under the trade mark "OMNI-FLOW". According to this known system a positive airflow will be provided and where in the ventilation system a negative ionization system may optionally be provided which, by affecting the air issuing from the ventilation system, will cause a reduction in tiredness and an increase in the power of concentration among the personnel in the operating theatre. Furthermore, this known system makes known that a reduction in airflow brings about a reduction in air treatment at the site of the operation. This is due to convection heat from surgical lamps, the patient and so forth Moreover, four blow-out quadrants create problems of striking accuracy in relation to the zone of activity on the operating table.

By way of elucidating the prior art, mention can be made of Swedish Patent 419126 which concerns a solution where the division into zones does not allow for a variable function and, in addition, temperature control is problematic.

British Patent 1127793 relates to a use of an "air curtain", which in a operating theatre environment is a risk because there is a danger that particles may be broken away and come into contact with the patient's surgical incision.

Swedish Patent 345318 relates to a solution which requires ventilation in the floor surface. This also causes problems with regard to cleaning. The technical solution involves, in effect, an air curtain which is to protect persons in an outer area.

British Patent 1186554 relates to a solution where two jet rays are used in the outer zone of the ventilation system. This solution is not particularly favourable in an operating theatre environment either. The difference between these two known techniques is that British Patent 1349717 describes a solution by means of which a more even distribution of the air issuing from the main chamber is achieved.

British Patent 1565952 describes a technique which is reminscent of that made apparent in Swedish Patent 419126, but does not manage to provide a flow of air of a speed of the order of 0.5 m/sec to oppose convection currents. The taught assembly has the drawback that it becomes hazardous because the system becomes fouled by contaminants.

British Patent 1474732 relates to a technique associated with paint-spraying booths. Air extractors in the floor surface are used, which in the context of an operating theatre are not applicable, and the rate of air change is about 60 times per hour. In an operating theatre environment the renewal of air ought to take place at least 400 times per hour. The use of microfilters is not disclosed, and this known design results in very distinct temperature zones.

German Offenlegungsschrift 2512679 describes the use of local air purification, and no consideration is given to the clean zone need for instruments outside the purification zone.

German Offenlegungsschrift 3516488 describes an air conditioning plant for operating theatres where the air change takes place at a level that is too low, and where, in addition, a mixture of indoor air and clean air takes place.

One of the major drawbacks of these known plants has however been that the temperature in the operating theatre can become undesirably low or high in, for example, the operating table zone in comparison with the areas around the operating table. This may have direct consequences for the patient on the operating table and, moreover, may affect the efficiency of the personnel in the operating theatre, which in turn may become of significance for the outcome of the operation. In particular, excessive cooling of the patient may have dramatic consequences, possibly even resulting in death.

Empirically, the operating theatre is the source of more than 25% of all infections a patient may contract whilst in hospital. This entails an increase in the need for medical treatment, longer stays in hospital and larger payments from benefit schemes. Consequently, efficient air conditioning in an operating theatre is one of the most important preventive measures which ought to be found in a hospital, in respect of both hygiene in the operating theatre and the working conditions in which the personnel work and which may be of significance for the outcome of the operation. The operation technique used and the appropriate use of antibiotics before or after the operation are, of course, additional factors.

OBJECT AND SUMMARY OF THE INVENTION

As will be understood immediately, air ventilation technology is especially important for surgery in connection with orthopedics, neurosurgery, cardiac surgery and microsurgery, where exceptionally sterile conditions are especially required. It has been found that direct contact and airborne contaminants constitute almost 98% of the micro-organisms which come into contact with the surgical incision during major operations. Post-operative infections and where less sterile conditions are usually found are caused by micro-organisms which have no connection with the actual operating theatre.

However, it has become increasingly necessary to take into account not only the airflow which is supplied to the patient and the surgical incisions which are treated, but also the airflow which is supplied to the personnel carrying out the operation and the indoor air in general.

In recognition of this need, it is proposed, according to the present invention, that the section or sections which are designed to discharge air towards the zone of activity, form an I,H, T or Y-shaped air outlet surface on the ventilation system, and that one or more sections, in the marginal zone of the system, across a part of the surface of the outlet aperture, are equipped with adjustable interconnected air control fins which have different angular deflection in relation to one another.

According to a preferred embodiment of the assembly, three or more fins are provided, where adjacent fins are of differing lengths and where the projection of each fin decreases in the direction of the outer edge of the system.

It is an advantage if the fins are pivotally mounted and mechanically interconnected by means of a toothed belt or similar. The angular deflection of the respective fins increases gradually from one fin to the next, such that when one fin has an angular motion of 7.5°, the next fin may have an angular deflection of 15°, and with an additional increase in angular deflection of 7.5° for each fin. However, it is possible to vary the increase in angular deflection, optionally only for two adjacent fins.

The mechanically interconnected fins may be actuated by, e.g., a motor, preferably a voltage controlled motor, which is caused to operate as a result of manual control, or as a function of the airflow in the near zone of the ventilation system, by the humidity and/or temperature of the air.

It is possible to provide a preferably manually operable, air directing fin or foil in connection with the sections which are designed to emit air down towards the zone of activity, e.g., an operating table.

According to further embodiments of the assembly, means are provided, in connection with one or more sections, to control air humidity.

When said zone of activity is an operating table in an operating theatre, it is especially important to reduce the cooling of the patient on the operating table. The cooling of a patient is due to evaporation from the surgical incision/operation area. By supplying temperature-controlled and humidity-controlled air, a previously non-achieved, active prevention of hypothermia problems during operations is achieved.

Furthermore, it is advantageous to provide one or more of the sections with equipment for bioclimatization or bioconditioning the air. Bioconditioning should be understood to mean a plus/minus alternating current ionization which has a sterilising effect, e.g., in the operating theatre. This is an inventive novelty within the field of operating theatre air hygiene. Test results indicate that bioconditioning will be far more effective than UV light, even as much as five to six times more effective over time. This is due primarily to the fact that bioconditioning does not have areas with fields of shadow, as is usual for UV light. The usual ionization systems, e.g., negative ionization, are only capable of eliminating some bacteria in connection with a certain degree of increased extraction of agglomerated dust and/or bacteria particles. Bioconditioning also has a sterilizing effect directly on the fields of shadow and in nooks and crannies. Bioconditioning equipment works with special radiation frequencies for the ionization of oxygen in particular.

Furthermore, it would be advantageous if at least the air which is taken from the indoor air were to flow via sound absorbers/pressure distribution mats to the ventilator fan provided for each section, and that on either side inclined outwardly from the outlet of the fan towards the end of one substantially horizontal sound plate positioned below the fan, there is provided a disk-shaped sound absorber and diffuser. The air which is expelled from the fan will pass across the sound plate and be deflected therearound en route to the outlet aperture of the section.

It is of advantage if sound-absorbing material is provided on the underside of the said sound plate, and if vertical air baffles extending from the outlet aperture of the fan to or beyond the end of the sound plate are provided.

The outlet aperture of the fan may be provided with a microfilter in a known way per se. Novel in this connection is that the special and needs-adjusted sectioning also makes possible rational sectioning of different degrees of microfiltration, which is advantageous for obtaining optimum air volume and filter economy.

The expelled air from each section is provided with a purity within the range of 0.1 to 10 cfu/cu.m, the actual operation area having a purity within the range of 1 cfu/cu.m.

In a known way per se, a vertically extending slot is provided in the centre of the ventilation system for securing a support pillar for a light fitting.

BRIEF DESCRIPTION OF THE DRAWINGS

The invention will now be described in more detail with reference to the attached drawings which illustrate non-limiting embodiments of the invention.

DETAILED DESCRIPTION OF THE PREFERRED EMBODIMENT(S) OF THE INVENTION

Figure 1:
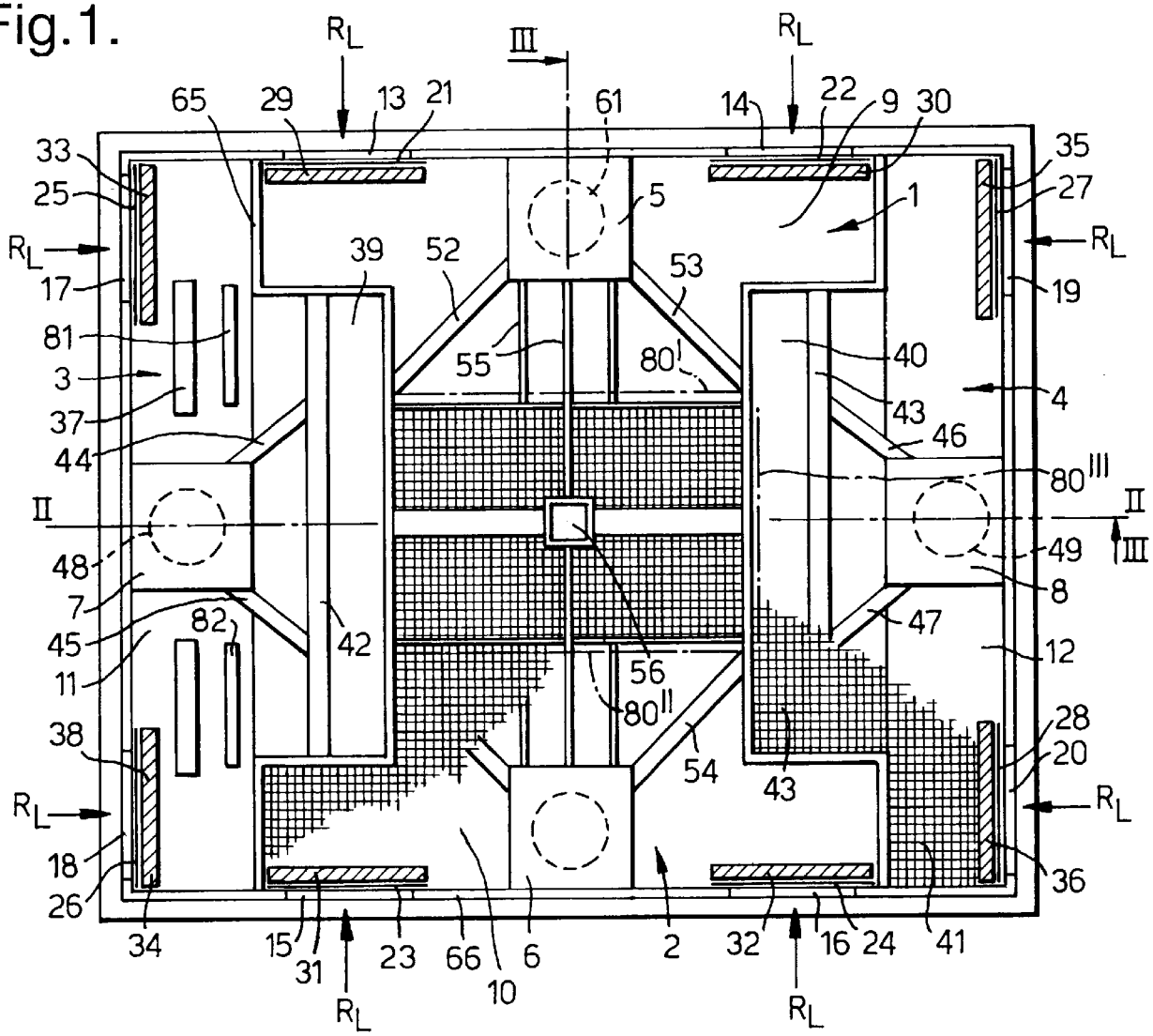
FIG. 1 illustrates the assembly, according to the present invention, seen from above in a first embodiment, with the top panel of the assembly removed.

FIG. 1 illustrates an embodiment of the assembly where there are four sections designated by the reference numerals 1, 2, 3 and 4. Each of the sections is equipped with a fan, respectively designated by the reference numerals 5, 6, 7 and 8. Said fans are mounted on respective sound plates 9, 10, 11 and 12, said plates serving as sound absorbers. Optionally said sound absorbers may also function as air filters.

According to the proposed example, the respective sections are equipped with air intake apertures in order to provide the ventilation unit with intake air in the form of air from the surrounding space. The air intake apertures for section 1 are designated by the reference numerals 13, 14, for section 2 by the reference numeral 15, 16, for section 3 by the reference numerals 17, 18 and for section 4 by the reference numerals 19, 20. Inside the respective air intake apertures 13–20, there is provided a preliminary filter which serves as a coarse filter and/or fluff filter and is designated for the respective apertures by the reference numerals 21, 22, 23, 24, 25, 26, 27 and 28 respectively.

In order to be able to ensure mutually independent temperature control of the air which is to be emitted from each section, according to the illustrated embodiment, in connection with respective air supply apertures 13–20, temperature control batteries are supplied, designated respectively by the reference numerals 29, 30, 31, 32, 33, 34, 35 and 36. As mentioned, it would be advantageous, in connection with one or more of the sections, to provide a bioconditioner of the alternating current ionization type, thereby increasing air hygiene, reducing the amount of dust, reducing static electric problems and improving the working conditions in an operating theatre. As an example, a bioconditioner of this kind is shown in connection with section 3 and is indicated by means of reference numerals 37 and 38.

As shown in connection with sections 3 and 4, respective fans 7 and 8 are mounted on respective baffles 11 and 12. The air will be guided around respective baffles 11 and 12 past a sound plate 39 in section 3 and a sound plate 40 in section 4. Before the air is emitted from sections 3 and 4 it must pass through a microfilter 41. A part of sections 3 and 4 may optionally be equipped with an additional temperature control battery, designated respectively by the reference numerals 42 and 43.

Furthermore, there may be humidifying means in the form of steam discharge manifolds 81 and 82, see FIGS. 1, 2, 3 and 4.

Sections 3 and 4 are also equipped with diffuser elements or sound absorber elements 44 and 45, and 46 and 47 respectively, and similarly such elements are also found in sections 1 and 2, designated by the reference numerals 52, 53 and 54 respectively. Normally it would be sufficient to have a supply of indoor air ($R_L$) to sections 3 and 4, but according to the present invention, it will also be possible to supply air from the building's central ventilation system SA, and this air, designated SA, may, in the case of sections 3 and 4, be supplied via connecting pipes 48 and 49. This air would normally have an absolute minimum of impurities and may pass through a filter 50, 51 for sections 3 and 4 respectively before the air passes into the section.

As indicated by means of the broken lines in FIG. 1, the connecting pipes 48 and 49 are preferably located above the fan housing 7, 8, although a different location of such connecting pipes would be possible within the scope of the invention.

In connection with sections 1 and 2, as will be seen, there are also diffuser plates 52, 53 in section 1 and similarly diffuser plates in section 2, designated by the reference numeral 54, as only one of the plates is indicated by means of a reference numeral. In addition, it would be of advantage if, in the direction of the airflow from the fan, vertical air baffles 55 were located extending from the outlet aperture of the fan to or beyond the end of the sound plate 9 (in the case of section 1) or 10 (in the case of section 2).

A vertically extending slot 56 is provided in the centre of the ventilation system for securing a support pillar for a light fitting.

Figure 2:
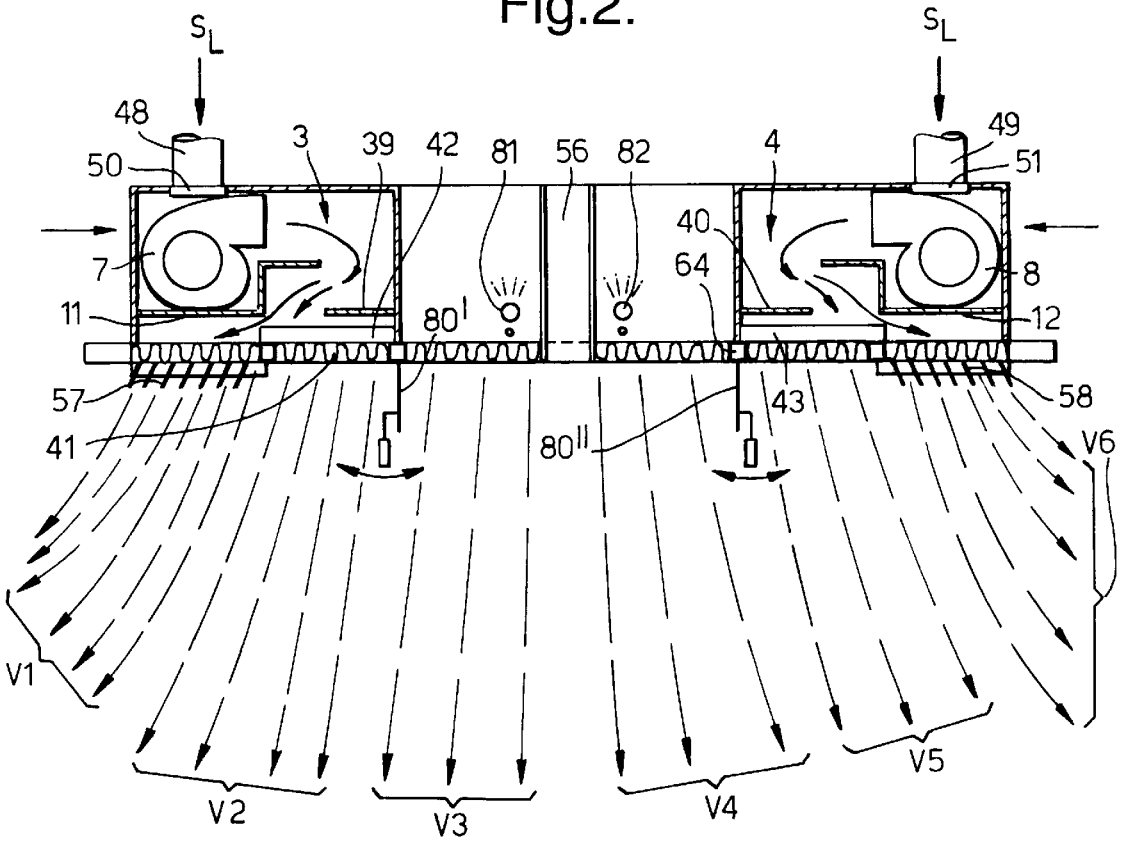
FIG. 2 shows the section II—II in FIG. 1.

As can be seen from FIG. 2, it would be advantageous to provide across a part of the surface of the outlet aperture flat air guide fins 57, 58 for sections 3 and 4 respectively and air guide fins 59, 59', for example, in sections 1 and 2. Larger individual fins will also be capable of being used manually to re-adjust the division between the different zones in accordance with the user's wishes. A more detailed 15 explanation of the use of fins will be given in connection with the attached FIGS. 7 and 8.

In the present example, sections 1 and 2 are identical, and with reference to FIG. 3, these sections will be explained in more detail. The air issuing from the fan 5 will pass around the sound plate 9, as shown. The sound plate is preferably provided with sound absorbing material on the underside thereof, designated by the reference numeral 60. In the illustrated embodiment, sections 1 and 2 will preferably be the two sections which supply the actual operating table with purified air. For this reason it would be advantageous if the intake of indoor air were limited and optionally based on the greatest possible supply of the cleanest possible air from the building's central system, i.e., a supply of air SL as shown on FIG. 3. This air SL is introduced into section 1 via a connecting pipe 61 and a filter 62. It will be understood immediately that the same applies to section 2.

With the disclosed design according to FIG. 1, it will be possible to achieve an airflow pattern as, for example, shown in FIG. 2, where different types of microfilters can be provided, seen from the left towards the right in the figure. The filtration in the illustrated embodiment will be the shortest distance possible to the left and the farthest possible to the right where the number of impurities per cu.m of air is, for instance, 10. In an adjacent part of sections 3 and 4, an improved filtration will be carried out, e.g., totalling five impurities per cu.m of air, since this ventilation area is closer to the operating table. Above the actual operating table, i.e., immediately below sections 1 and 2, the microfilters and the air supplied to the sections are of such a nature that the air issuing from the sections has, for example, between 0 and 1 impurity per cu.m of air.

It will also be immediately understood that it would be possible to control the velocity at which the air issues forth from the individual sections separately. Because of the extra temperature control battery 42, 43 in sections 3 and 4 respectively, the air velocity will be less in connection also with the fact that the microfilter adjacent to this battery has a greater filtration capacity. Consequently, in the case of sections 3 and 4, the opportunity arises to operate with velocities V1 and V2 and V5 and V6 respectively, whilst for sections 1 and 2 one may operate with air velocities V3 and V4 respectively. It will be understood immediately that the velocities V1 and V6 and also V2 and V5 may be different, just as velocities V3 and V4 may be different. However, these respective velocities may also be selected to be substantially alike. Velocity control for the respective air velocities will be possible, which will be instrumental in achieving desired air patterns in a given operating theatre under the operating conditions prevailing therein.

To be able to ensure an expedient mounting of the microfilters with grilles, on the top of the microfilters permanently attached to the framework of the ventilation system there are provided support pillars 63, 64 so that the microfilters 41 may be secured to the beams with the aid of an attachment fitting and use of a screw/bayonet connection.

As can be seen from FIG. 1, the two sections 1 and 2 which supply air to the actual operating table area together have an air outlet surface which forms an I or an H-shape.

Figure 6:
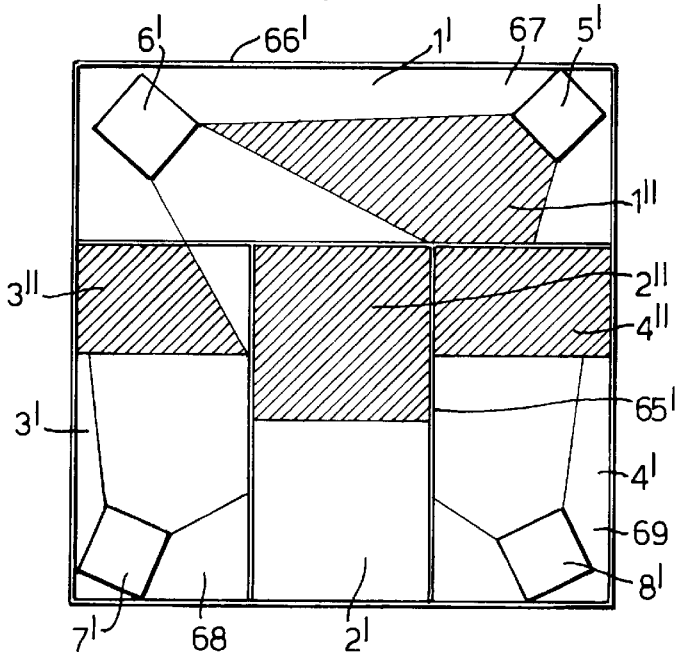
FIG. 6 is a schematic illustration of an alternative of the emdodiment shown in FIG. 1.

As is shown in FIG. 6, corresponding sections 1' and 2' have an approximate T or Y shape. The corresponding sections for areas outside the operating table in FIG. 6 are designated by the reference numerals 3' and 4' respectively. The fans in sections 1', 2', 3', 4' are designated by reference numerals 5', 6', 7' and 8'. The air outlet areas from the respective sections are designated by the reference numerals 1", 2", 3" and 4" in FIG. 6. As is shown in more detail in FIG. 7, in the section/chamber above the operating table, steam manifolds may be provided in a number, size and length such that essentially the air flowing down towards the area of patient's surgical incision is humidified, in addition to the air temperature being given a best possible optimum value.

As is shown for the embodiment in FIG. 1, where dividing walls 65 are used between the sections, in addition to the outer wall 66 of the ventilation system, similar dividing walls 65' and outer wall 66' will be used in the embodiment illustrated in FIG. 6. The fans 5', 6', 7', 8' are mounted on sound plates 67, 68 and 69. However, it should be understood that the embodiment shown in FIG. 6 is only included to illustrate the countless possible variations of the assembly that lie within the scope of the present invention.

Figure 4:
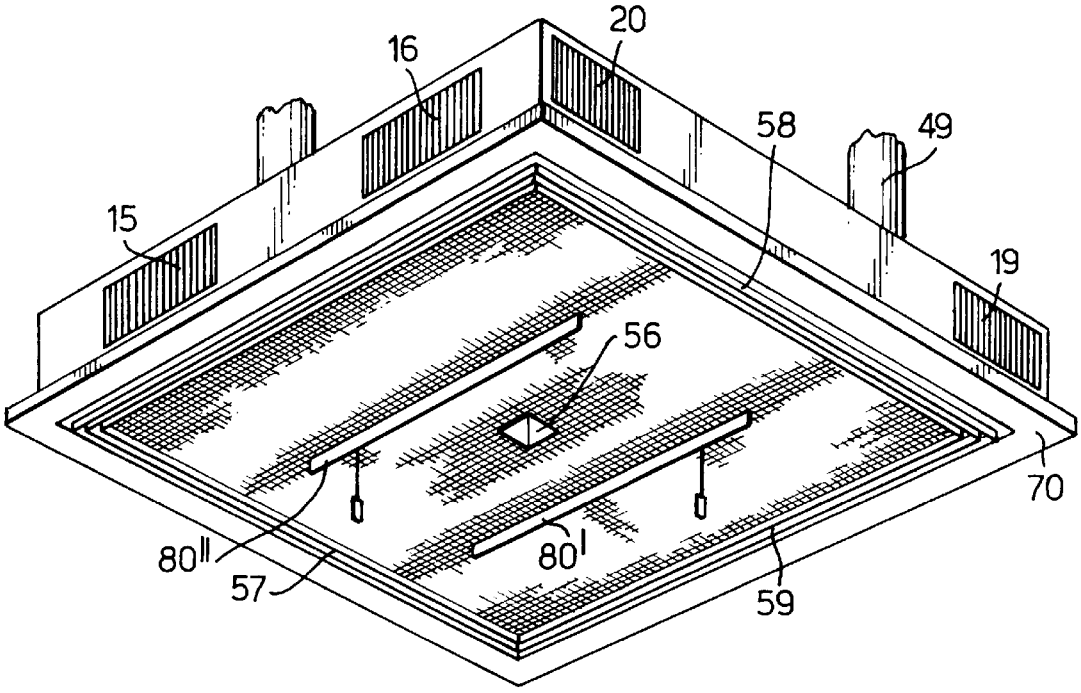
FIG. 4 is a perspective view of the assembly according to the invention, seen from below.

In FIG. 4 the ventilation system is illustrated in perspective, seen from below without a surgical light fitting mounted. In one preferred, but for the invention not limiting, embodiment, a strip light 70 of a known type per se may be placed along the periphery of the ventilation system. This strip light will provide the area around the operating table with ordinary lighting, whilst the actual operating table and patient will be illuminated by a special surgical light fitting, designated by the reference numeral 71 in FIG. 5. The fitting 71 is supported by a support pillar 72 which is secured to the ceiling in the actual operating theatre. The fitting is supplied with power via a cable 73.

Central air (SL) from the building's central ventilation system is conducted to the ventilation unit in the operating theatre via ventilation duct 74 and the said connecting pipes 48, 49 and 61. This air is controlled optimally with regard to temperature and volume. The volume of air will also be an important means to be varied to the correct amount, related to the room's size and height under the ceiling, whereby the most efficient air pattern possible may be provided, i.e., the largest possible clean zone in relation to the filter area. Air from the operating theatre 75 is conducted partly as return air RL back to the ventilation system via intake apertures, on FIG. 5 designated by the reference numerals 15 and 16, and partly via a feedback duct 76 which leads back to the building's central ventilation system SA to be purified there and recirculated. When the system is produced without internal fans, about 70% of the return air RL will pass via a closed chamber to duct 76. In this case, return apertures are provided on the top of the unit, preferably one or two for each side, thereby making possible readjustment of the division between the different treated air volumes in the individual sections or zones.

Figure 5:
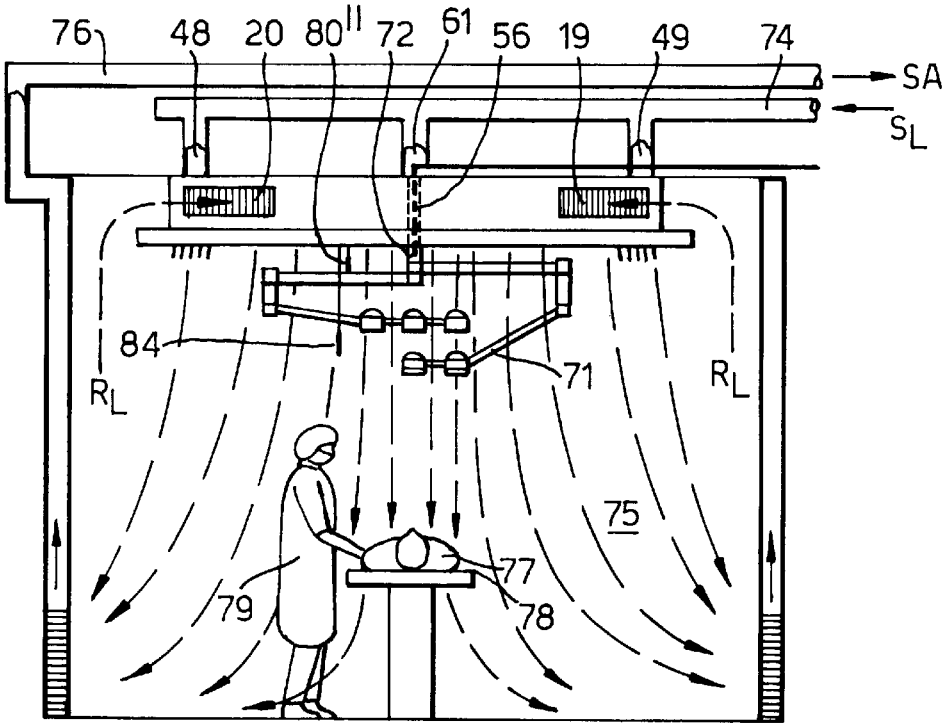
FIG. 5 illustrates the mounting method and utilisation of the assembly in an operating theatre.

In FIG. 5 the reference numeral 77 designates a patient lying on the operating table 78 and undergoing an operation carried out by a surgeon 79.

As shown in FIG. 1, air guide fins 80 (designated specifically by 80', 80" and 80'") can be provided in the area at the zone of activity, i.e., for instance an operating table in an operating theatre. In the example in FIG. 1, the fin 80" may be manually operated by the surgeon.

Similarly, the fin 80' is operated by the surgeon's assistant, whilst the fin 80'" can be operated by the anaesthetist.

A fin in the context of the present application is an aerodynamic body in the form of a foil, wing profile, shaped, elongate plate or similar. A fin of this kind may optionally be made in the form of an extruded profile.

Figure 7:
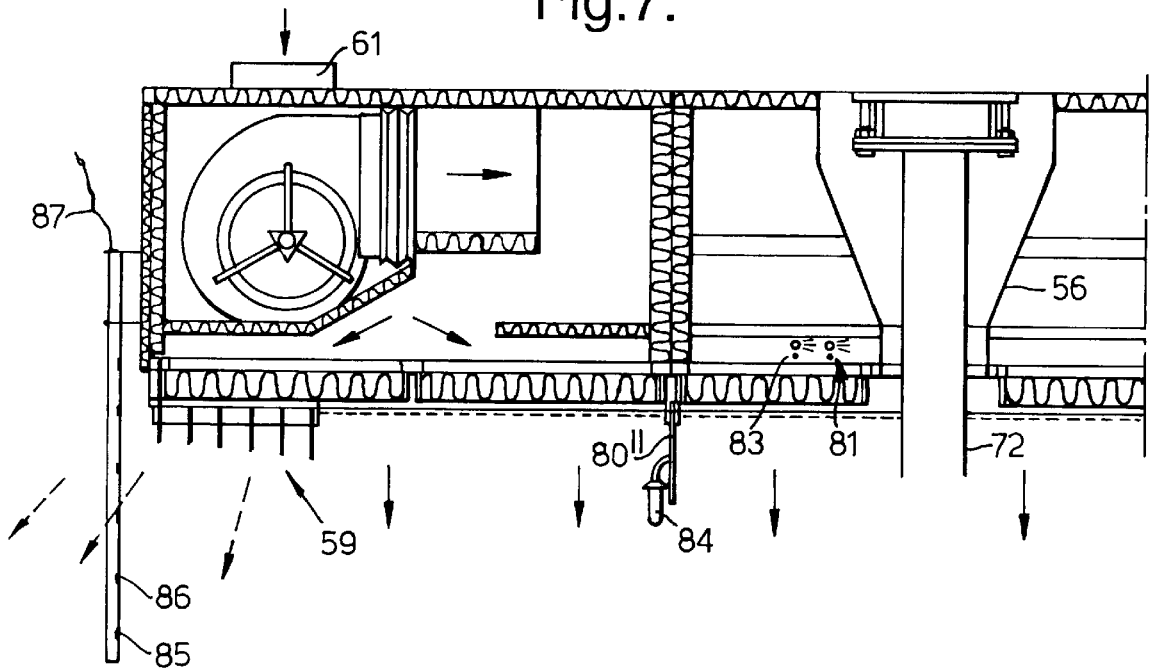
FIG. 7 shows an enlarged detail of the embodiment in FIG. 2.

The reference numerals 81 and 82 designate steam jets for humidifying the air which is to be expelled from the respective section in the system (see also FIGS. 2 and 7). A condensation hose 83 (see FIG. 7) may optionally be provided on the underside of the steam manifold.

Figure 3:
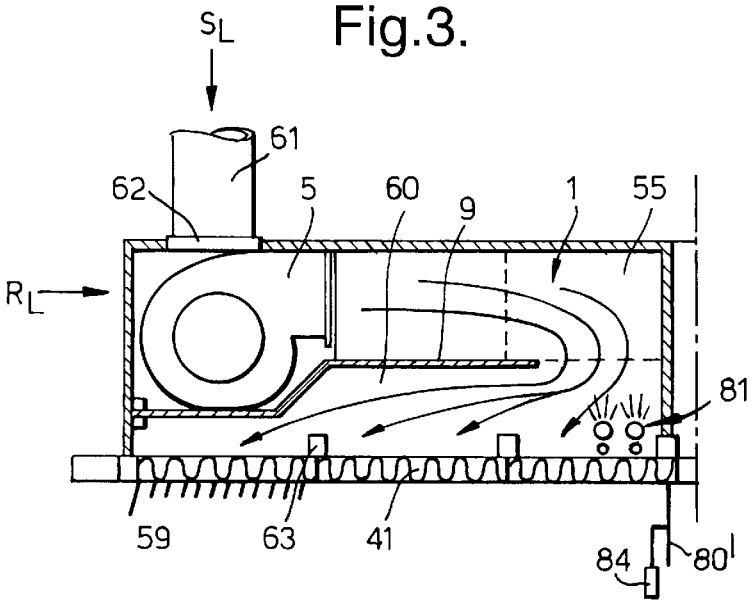
FIG. 3 shows the section III—III in FIG. 1.

As shown in FIGS. 3 and 7, the manually operable fins 80 may be provided with a handle 84. In an operating theatre context, the handle may be made so as to be replaceable, so that for each operation it is sterile.

In FIG. 4 the said fins 80, or more precisely only 80' and 80" are indicated, whilst for the sake of clarity only the fin 80" is shown in FIG. 5.

In FIG. 7, which is a somewhat enlarged and more detailed version of FIG. 3, one of the said steam manifolds is shown (reference numeral 81). The air guide fin unit 59 in the marginal zone is illustrated having gradually smaller projections as the position of the fin approaches the outer edge of the ventilation system. This will be described in detail in connection with FIG. 8. An air detector unit 85 may be attached to the outside of the system with spaced detectors 86. The detectors may be designed to detect, e.g., airflow, airflow velocity, air temperature and/or humidity in the air. A cable 87 will connect the unit with a signal processor, as will be explained in connection with FIG. 8.

Figure 8:
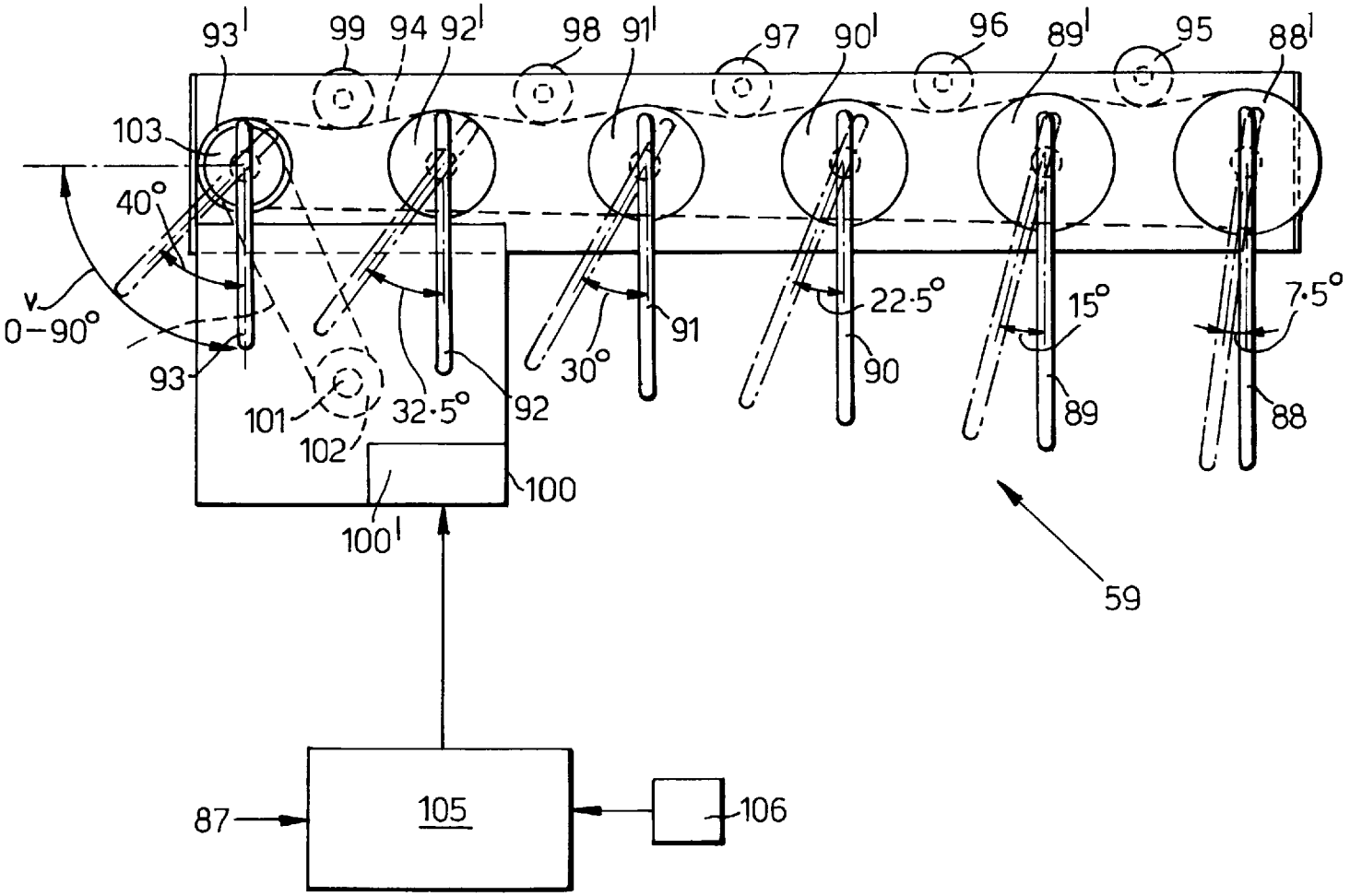
FIG. 8 illustrates a typical embodiment of mechanically interconnected air control fins.

In FIG. 8, the unit 59 of air fins 88, 89, 90, 91, 92 and 93 is illustrated. The unit would, of course, be able to contain more or fewer fins. In the present embodiment, each fin is respectively attached to a rotatable cogwheel 88', 89', 90', 91', 92', 93'. To ensure a mechanical connection between the cogwheels either intermediate cogwheel connections or a chain or a toothed belt 94 may be used as indicated. It is of advantage to use, in addition, pressing wheels 95, 96, 97, 98 and 99 between the adjacent cogwheels 88'–93' to hold the connection taut and prevent the fins from flapping in relation to one another. The fins 88–93 are moved as a unit 59 by means of a motor 100 which has a drive shaft 101 mounted on a cogwheel 102. On the spindle of the cogwheel 93' a further cogwheel 103 is attached, and a chain or a toothed belt 104 forms a connection between the cogwheels 102 and 103. The motor 100 may contain a conversion circuit 100' which causes the angle of rotation of the motor shaft to be a function of the voltage which is supplied to the circuit 100'. Such motors having built-in conversion circuits are common commercial products. Alternatively, the motor 100 may be a common stepping motor. The voltage supplied may, for example, lie within the range of 0–10 volts, although this should not be perceived as a limitation.

It may be appropriate to allow the motor to be controlled by a microprocessor 105 so that the motor 100 either may be controlled automatically as a result of the detected parameters which are transmitted from the detector unit 85 via the cable 87, or controlled manually from a control box 106.

In the proposed embodiment, the fin 93 will be capable of being rotated through an angle v of 90°. The angular deflection for the other fins 92–88 will be gradually smaller. In the illustrated position of the fins, these have a different angle to one another. Thus, there is selected, in a preferred embodiment, although not limiting for the invention ,a rotational ratio between the fins 88–93 equal to 7.5:15:22.5:30:32.5:40.

The purpose of the air fins 88, 89, 90, 91, 92, 93 is to prevent the penetration of impure air into the pure air area in an optimum manner, whilst obtaining the largest possible pure air area.

Although the present invention has been illustrated and described with reference to preferred embodiments, it will be understood immediately that modifications may be made within the scope of the attached patent claims and/or within the scope of what must appear obvious for a person versed in the art when the teaching provided by the present application is taken into consideration.

I claim:

1. A ceiling-mounted ventilation system assembly for an operating theatre, from which assembly ventilation air is directed down towards a working area, and where air is supplied to the ventilation system assembly from indoor air and/or from external ventilation equipment, where said ventilation system assembly is divided into at least four mutually separate air sections, and where said sections are each independently equipped with means to control the air volume passing through the section, and means for ensuring a predetermined purity of air which is emitted, characterised in a section or sections being designed to emit air towards zones of different activity, and the surgeon side thereof, said air coming from an air outlet face of the assembly which forms part of a rectangular, total air outlet face of the assembly, said partial outlet face having an outlet region of substantially I, H, T or Y-shape, and that one or more sections, at marginal zone of the assembly, across part of the surface of the air outlet face thereof is equipped with a plurality of air guide fins which upon common movement from an initial position have means for different angular deflection or excursion from one another, said respective angular deflection or excursion of the fins increasing from one fin to the next.

2. The assembly as disclosed in claim 1, characterised in that three or more fins are provided, where adjacent fins are of different lengths and where the projection of each fin diminishes in the direction towards an outer edge of the system assembly.

3. The assembly as disclosed in claim 1, characterised in that the fins are pivotally mounted on cogwheels of gradually reduced diameter in a direction towards an outer edge of the assembly and mechanically interconnected, by means of a toothed belt.

4. The assembly as disclosed in claim 1, characterised in that the interconnected fins are actuated by a motor, the operation of said motor being controlled manually or as a function of airflow in the near zone of the ventilation system assembly, by the humidity and/or temperature of the air.

5. The assembly as disclosed in claim 1, characterised in that in connection with sections designed to emit air down towards a zone of activity, one or more manually operable, air directing fins or foils are provided.

6. The assembly as disclosed in claim 1, characterised in that in connection with one or more of the sections, means for substantially increasing and regulating air humidity in the air directed toward an operative area on a said patient.

7. The assembly as disclosed in claim 1, characterised in that in connection with one or more of the sections, equipment for bioconditioning, with both positive and negative ionization, of expelled air is provided.

8. The assembly as disclosed in claim 1, characterised in that a microfilter is provided at the outlet face of the section.

9. The assembly as disclosed in claim 1, characterised in that the expelled air from each of the sections is given a purity within the range of 0.1–10 colony forming units/cubic meter (cfu/$m^3$).

* * * * *